United States Patent [19]

Watkins et al.

[11] Patent Number: 4,691,374

[45] Date of Patent: Sep. 1, 1987

[54] COOKING BAG WITH DIAGONAL GUSSET SEALS

[75] Inventors: James D. Watkins, Prior Lake; David W. Andreas, Minneapolis, both of Minn.

[73] Assignee: Golden Valley Microwave Foods Inc., Edina, Minn.

[21] Appl. No.: 721,458

[22] Filed: Feb. 19, 1985

Related U.S. Application Data

[63] Continuation of Ser. No. 522,268, Aug. 11, 1983, abandoned.

[51] Int. Cl.[4] ..... B65D 30/16

[52] U.S. Cl. ..... 383/104; 383/38; 383/100; 383/120; 383/125; 426/107; 426/111

[58] Field of Search ..... 383/38, 40, 104, 120, 383/121, 124, 125, 122, 100; 426/107, 111, 113, 115

[56] References Cited

U.S. PATENT DOCUMENTS

| | | | |
|---|---|---|---|
| 2,041,227 | 5/1936 | Chalmers | 383/122 X |
| 3,027,261 | 3/1962 | Samara | 383/100 X |
| 3,052,554 | 9/1962 | Colman | 426/111 |
| 3,286,832 | 11/1966 | Pilger | 206/365 |
| 3,293,048 | 12/1966 | Kitterman | 426/113 |
| 3,637,132 | 1/1972 | Gray | 383/100 |
| 3,851,574 | 12/1974 | Katz et al. | 426/107 |
| 3,873,735 | 3/1975 | Chalin et al. | 426/107 X |
| 3,970,241 | 7/1976 | Hanson | 383/124 |
| 4,450,180 | 5/1984 | Watkins | 426/107 |

FOREIGN PATENT DOCUMENTS

| | | | |
|---|---|---|---|
| 81544 | 12/1956 | Denmark | 383/38 |

*Primary Examiner*—Stephen Marcus
*Assistant Examiner*—Bryon Gehman
*Attorney, Agent, or Firm*—James V. Harmon

[57] ABSTRACT

A paper bag is described comprising a pair of face panels, one of which may be narrower than the other, joined by centrally extending gussets. The bottom and top of the bag are sealed, the bottom with a permanent seal and the top with a rupturable seal formed from thermoplastic adhesive so that the top can open to form a vent when products, e.g., foods, are heated within the bag in a microwave oven. The strong bottom seal may consist of diagonal seals that extend diagonally from the center of the bag toward the side edge. One or more temporary transverse seals can be provided near the center of the bag.

10 Claims, 27 Drawing Figures

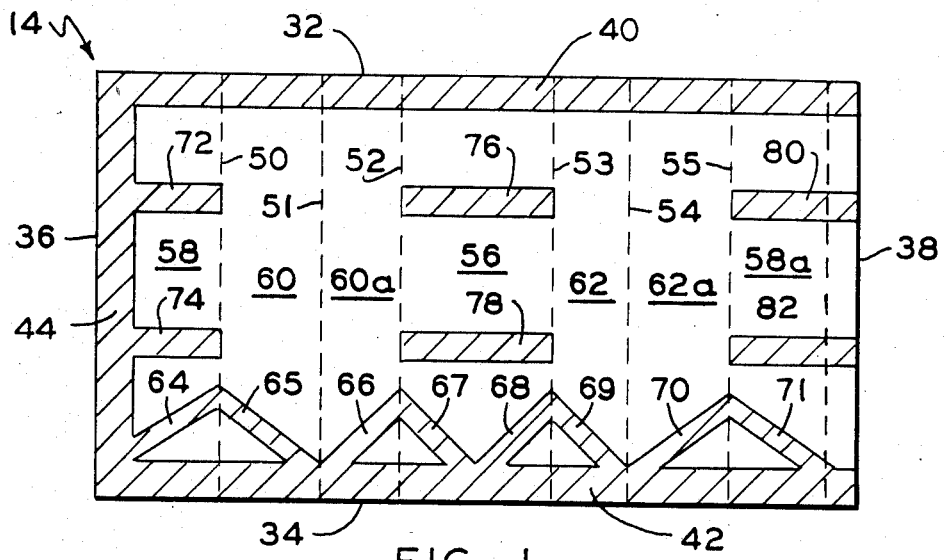
FIG. 1
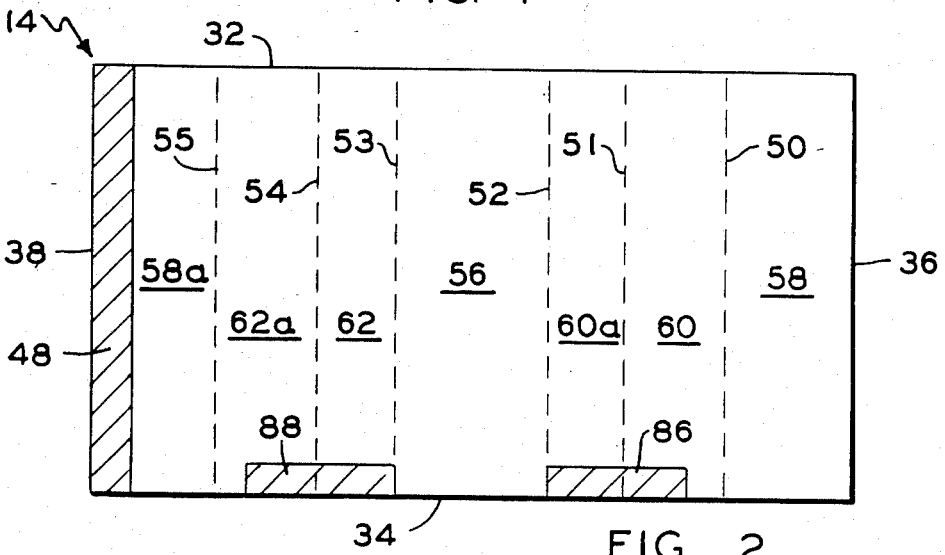
FIG. 2
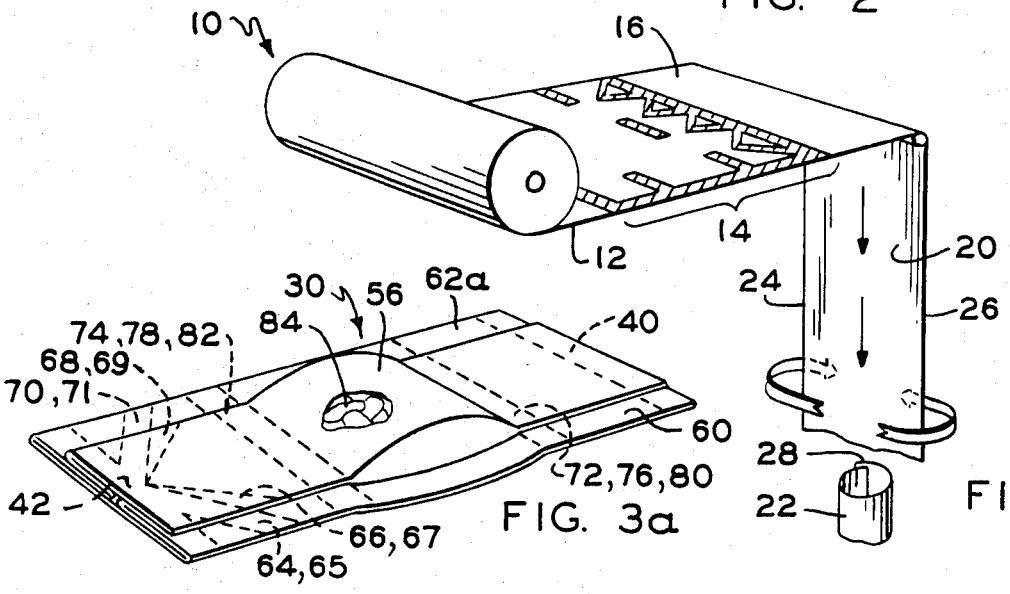
FIG. 3a
FIG. 3

COOKING BAG WITH DIAGONAL GUSSET SEALS

This is a continuation of application Ser. No. 522,268, filed 8-11-83, now abandoned.

FIELD OF THE INVENTION

The present invention relates to shipping bags and more particularly to flexible bags suited for shipping, storing and displaying articles.

BACKGROUND OF THE INVENTION

Various kinds of square cut or square end gusseted bags have been previously proposed for shipping and displaying articles. The bag usually has a label clearly displaying the type of product contained in the bag together with the brand name of the manufacturer. These bags have had certain shortcomings for particular applications. One of the problems is that the product can easily shift in the package. Another problem is that while square ended gusseted bags are inexpensive and have been successful for many applications, they do not provide a flat bottom when the bag is expanded. Morever, the gussets at the bottom of such a bag are held in the transverse seal at the bottom and therefore project into the center portion of the bag occupying a substantial amount of space that would otherwise be unobstructed. This can interfere with the product contained in the bag. Thus, in some applications, after the bag is expanded and the top has been opened, the ends of the gussets captivated between the bottom edges of the bag prevent the product inside from moving around freely. They also prevent a person from removing the product easily. This is because the gussets form four small pockets at the bottom of the bag within which the product can become trapped so that it is difficult to remove. Yet another shortcoming of the prior bags is the difficulty of forming and filling them at high speeds on the order of, say, about 100 per minute, while at the same time providing strong, durable seals including a longitudinal seal to bond the side edges of the sheet from which the bag is formed, a pair of transversely extending end seals, i.e., top and bottom seals and, if desired, one or more transversely extending product locating seals positioned intermediate the top and bottom ends of the bag and extending laterally from one side edge of the bag to the other.

The bag of the present invention overcomes these problems. It can be used to ship a variety of products such as personal and hardware items, articles that are displayed on racks in retail stores, fresh produce, snacks, soft goods, candies, cookies, plant foods, insecticides, cereals and the like. The invention is particularly useful for products that expand such as chemicals or foods such as popcorn which should be stored in a relatively small space but be free to expand into a much larger volume as it pops. The invention has a variety of other applications which will be apparent to those skilled in the art.

SUMMARY OF THE INVENTION

Briefly, the present invention provides a gusseted bag that is formed from a piece of flexible sheet material folded to form a pair of parallel face panels connected by gusset folds. While the face panels may be of equal size, it is preferred that the front panel is relatively narrow so that its side edges are spaced inwardly from the side edges of the back panel. Between the panels are located left and right connecting gusset folds. When the face panels are of different widths, each gusset has one narrow and one wide panel positioned adjacent one another and connected together by a gusset fold. When the bag is in its flat condition, the gussets extend toward one another preferably almost to the center of the bag. In this situation, the gussets are adjacent to one another and close enough to divide the bag into two parallel tubes, namely a front tube between the front panel and the gussets and a back tube between the back panel and the gussets. The back tube is preferably larger in its diameter than the front tube.

Diagonal seals are preferably provided on at least one end of the bag. These diagonal seals when present are provided at least at the bottom of the bag to form a flat bottom surface for the bag so that, if desired, it can be stood on end once it is fully expanded. The diagonal seals also cause the gussets to be folded so that they do not extend into and occupy the center portin of the bag and possibly interfere with the distribution, movement or removal of the product in the bag. The diagonal seals are made between the gussets and the face panels and comprise a first pair of diagonal seals on one side of the bag beginning at the center of the bag and extending upwardly and laterally between each gusset panel and a portion of the adjacent face panel in contact with it. A second pair of diagonal seals extend on an incline upwardly and laterally from the center of the bag toward the right between each of the gusset panels and the adjacent face panel. The diagonal seals form folds in the gussets when the bag is expanded to produce a flat bottom for the bag as seen from the inside.

The seals between adjacent plys of the bag are preferably heat seals formed by coating the surface of the sheet material with one or more layers of heat sealing adhesive followed by the application of heat and pressure sufficient to bond the panels together. In one preferred form of the invention, heat sealing adhesive is provided on both adjacent surfaces in face-to-face contact so that one layer of adhesive is sealed to another to provide a secure seal.

In accordance with a preferred form of invention, at least one product locating seal is provided. The product locating seal extends transversely across the bag from one side to the other of at least the smaller tube to divide it into upper and lower compartments between the product locating seal in the top of the bag and the product locating seal in the bottom of the bag. In one form of the invention, two laterally extending vertically spaced apart parallel product locating seals are provided intermediate the ends of the bag with substantial space between them where the product is held during shipment and storage.

One or both of the product locating seals is formed from thermoplastic adhesives so that it will easily melt and come open when heat is applied.

BRIEF DESCRIPTION OF THE DRAWINGS

FIG. 1 is a plan view of the inside surface of a blank sheet of paper from which the bag is formed.

FIG. 2 is a view similar to FIG. 1 showing the outside surface of the sheet from which the bag is formed.

FIG. 3 is a perspective view showing a roll from which bags are formed as the sheet material appears when unwound and fed into a bag forming machine.

FIG. 3*a* is a perspective view of a complete bag in accordance with the invention as it appears after being filled.

DESCRIPTION OF THE PREFERRED EMBODIMENTS

Figure 4:
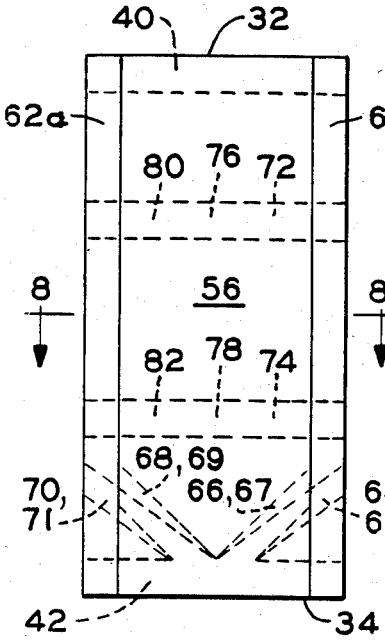
FIG. 4 is a plan view of the completed bag shown in FIG. 3*a*.

In overcoming the deficiencies described in connection with the prior art and to accomplish the foregoing and related ends, the invention is described by way of example, the following description setting forth in detail certain illustrative embodiments, the invention indicating, however, only a few of the variations that can be made in the invention within the scope of the appended claims.

Refer now to the drawings and particularly to FIGS. 1, 2 and 3 which illustrate a prewound roll 10 of web material from which the sheets making up the bag are taken. The roll 10 is unwound at 12 and includes a series of connected sheets 14 from which the bags are formed. The sheets are shown separately in FIGS. 1 and 2 as they would appear if detached from one another. Prior to forming the bags, the sheets 14 are part of a continuous web 16 which passes in FIG. 3 over a guide 18 and then travels downwardly at 20. The web 20 is formed into a tube 22 only a part of which is shown at the bottom of FIG. 3 by bringing the side edges 24 and 26 toward one another in overlapping relationship as shown at 28. The web 16 at this point is tubular. The equipment for forming continuous webs into a tube are well known to those skilled in the art. Any suitable commercially available equipment used for this purpose can be employed.

Refer now to FIGS. 1 and 2 which illustrate respectively the inside and outside surface of the sheet sections 14 from which the bag 30 is formed. It can be seen that the sheet 14 is generally rectangular in shape and includes parallel upper and lower edges 32 and 34 respectively with parallel side edges 36 and 38 running at right angles thereto. The edge 32 forms the top of the bag while edge 34 forms the bottom of the bag. The side edges 36 and 38 are bonded in overlapping relationship as will be described below to form a longitudinally extending lap seal 28.

On the inside surface of the sheet 14 are a pair of upper and lower thermoplastic adhesive sealing bands 40 and 42 respectively which can be applied using any suitable adhesive applying equipment. The adhesive bands 40 and 42 while they can be formed from any suitable commerically available adhesive, are preferably formed from a heat sensitive thermoplastic adhesive such as polyvinyl acetate adhesive. Other adhesives such as dextrine or starch base adhesives can be used if desired. Thermoplastic heat sealing adhesives are preferred when the bags are formed on high-speed automatic tubing and filling equipment in which case seals are produced by holding the adhesive bands 40 and 42 together under heat and pressure.

The bands 40 and 42 can be of various widths but a fairly wide band, for example a band about ¾" wide is preferred so that there is adequate room for "float," i.e., the variations in the position of the sheet 14 with respect to the heated sealing jaws used for forming the seals.

The longitudinal seal 28 is formed by providing vertically disposed adhesive bands 44 and 48 along the side edges 36 and 38 and on opposite surfaces of the blank sheet 14. The bands 44 and 48 are also preferably formed from thermoplastic adhesive but a quick-setting dextrine adhesive or a resin type adhesive can be used if desired. It will be seen that the layers 44 and 48 contact one another when the tube 22 is formed with an overlap 28. Consequently, a bond is formed between the two face-to-face adhesive layers. Similarly, with the end seals formed by adhesive bands 40 and 42, an adhesive band is always in contact with a part of the adhesive band on an opposing surface so that one layer of adhesive is sealed to another in face-to-face relationship. In this way, a secure bond is formed which is stronger than one produced with a single layer of adhesive bonded to plain paper.

The sheet 14 is folded during manufacture along six lines designated 50–55. The lines 50–55 do not indicate creases but only lines where folds will be formed when the bag is completely formed and assembled. Precreasing is not necessary for most applications. Between fold lines 52 and 53 is a front or face panel 56. The back of the bag is formed by panels 58, 58*a* on opposite sides of fold lines 50 and 55 respectively. Between the front face panel 56 and the back panel 58 are gusset panels, the one on the left in FIG. 1 being designated 60, 60*a*, while the one on the right is designated 62 and 62*a*. The gusset panels are connected by the gusset folds 51 and 54 respectively.

At the bottom of the bag are provided diagonal seals which correspond in position to diagonal adhesive bands 64–71. The seal lines corresponding in location to the diagonal adhesive bands act together to form a flat bottom surface for the bag when it is expanded as will be described more fully below. The diagonal seals comprise seals between the gusset and face panel comprising a first pair of diagonal seals on the left side of the bag where diagonal band 66 is sealed to band 67 and diagonal band 65 is sealed to band 64. Both seals are inclined upwardly from the center of the bag laterally and serve to bond each gusset panel to a portion of an adjacent face panel (front or back) in contact therewith. The second pair of diagonal seals correspond in position to the adhesive bands 68–71 and are inclined from the center of the bag upwardly and toward the right between each of gusset panels 62 and 62a and one of the adjacent front or back face panels. Band 68 is sealed to band 69 and band 70 is sealed to band 71. It should be clear that although adhesive bands have been shown on both the gussets and the adjacent face panels, it would be acceptable to use a band on only one of them although a somewhat less secure bond would be formed. For example, bands designated 65, 67, 69 and 71 could be eliminated and yet all of the seals corresponding to bands 64, 66, 68 and 70 would be formed when heat and pressure is applied to the overlapping plys. It will be noticed that the diagonal adhesive bands form triangles of two different sizes, the two outer ones being wider and corresponding in width to twice the width of the wider gusset panels 60, 62*a* whereas the smaller triangles at the center correspond in width to double the width of the small gusset panels 60*a* and 62.

Positioned at vertically spaced apart locations on the bag intermediate the ends thereof are parallel transversely extending longitudinally spaced apart product locating seals corresponding in position to thermoplastic adhesive bands 72, 74, 76, 78 and 80, 82. When the bag is fully formed as shown in FIG. 3*a*, the gussets are positioned between the front and back panels. As a result, the product locating seals formed in the positions corresponding to the adhesive bands 72–82 will not consist of adhesive sealed to adhesive but instead adhesive carried on the front and back panels will be bonded to the adhesive free surfaces of the gussets. Accordingly, the product locating seals will ordinarily not be quite as strong as those formed where a layer of adhesive is bonded to another layer of adhesive as in the bottom and top seals.

The product locating seals are optional and the most useful one is the bottom seal corresponding in position to bands 74, 78 and 82. With this seal formed and the bag completely assembled, a product 84 can be dropped in the open top defined by the edge 32 and will fall until it strikes the lower product locating seal corresponding to the adhesive bands 74, 78, 82. It will then be held in this position, in this case at almost the center of the bag. After the product 84 has been introduced in this manner, the top product locating seal 72, 76, 80 is formed, for example, by forcing a pair of hot sealing bars against the surface of the bag above the product 84 thereby sealing the bands 72, 76, and 80 to one another.

Figure 4A:
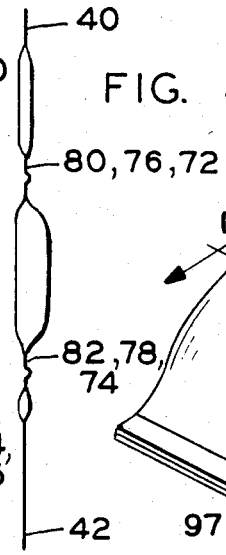
FIG. 4*a* is a diagramtic side elevational view of the bag of FIG. 4.
Figure 8:
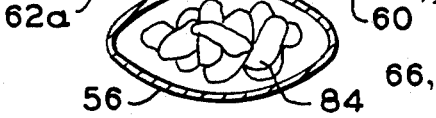
FIG. 8 is a transverse cross-sectional view taken on line 8—8 of FIG. 4.

As can be seen in FIG. 2, the lower edges of the outside surfaces of the gusset panels 60, 60*a*, 62, 62*a* are provided with adhesive bands 86 and 88. In this way, when the bag is assembled and a pair of hot sealing bars are brought into contact with the overlaping layers of the sheet material 14 forming the bottom of the bag, the outside or exposed surfaces of the gussets will be sealed to one another. This prevents the gussets from separating at the bottom edge of the bag 34. The product 84 is preferably placed in the smaller tube as shown in FIG. 8, that is to say, the one adjacent to the front face panel 56 rather than the large tube as shown in FIG. 8, that is to say, the one adjacent to the front face panel 56 rather than the large tube adjacent to the back face panel 58, 58*a*. Accordingly, when the product 84 is an expandable product such as a chemical or food to be cooked in the bag, it will be held in a very small space and is still able to expand to a volume many times greater due to the large expansion volume provided by the rear tube adjacent the rear panel composed of parts 58, 58*a*. On the other hand, some products can be placed on both sides of the gussets, i.e., in both the front and rear tubes. FIGS. 3*a*, 4 and 4*a* illustrate the complete bag filled with product ready for shipment.

Figure 6:
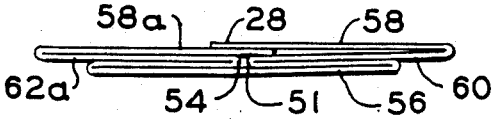
FIG. 6 is an end view of the bag of FIG. 4 on a larger scale.
Figure 7:
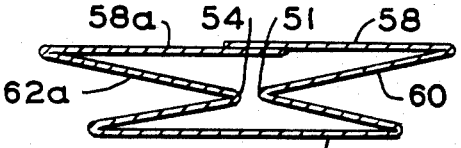
FIG. 7 is a cross-sectional view of the bag illustrating the dual tubular configuration of the bag as it appears when partly expanded.

Refer now to FIGS. 6, 7 and 8. The bag is normally in flattened condition while the product is being shipped or is on display. The gussets 60–62*a* are in contact with one another, and the face panel 56 and back panel 58, 58*a* is pressed against the adjacent gusset panels. When the product locating seals are used, the product 84 is placed between them and is located in the smaller tube, that is to say, the one between the front face panel 56 and the adjacent gussets. It will be noted that the gusset folds 51, 54 are positioned adjacent to one another and in the embodiment shown in the figures are almost in contact when the bag is flattened (FIG. 6). When the bag begins to expand (FIG. 7) gusset folds 51, 54 separate from one another. The location of the product 84 in the smaller tube can be clearly seen in FIG. 8, the larger or back tube is fully collapsed while the adjacent part of the front tube is expanded considerably to accommodate the product.

Figure 9:
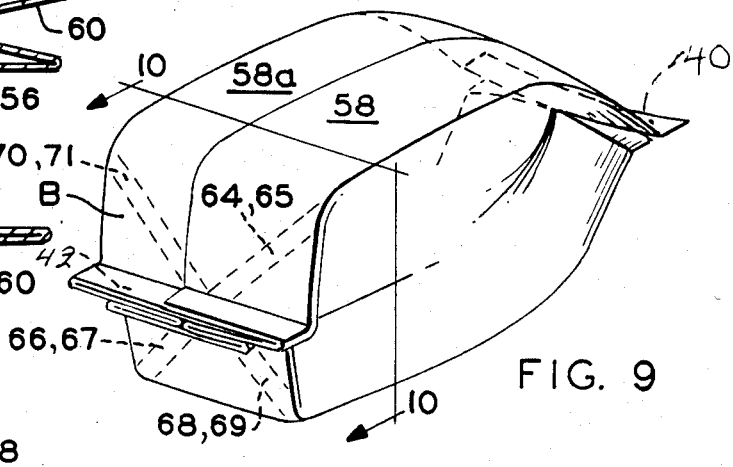
FIG. 9 is a perspective view of the bag in accordance with the invention as it appears in a fully expanded condition.
Figure 10:
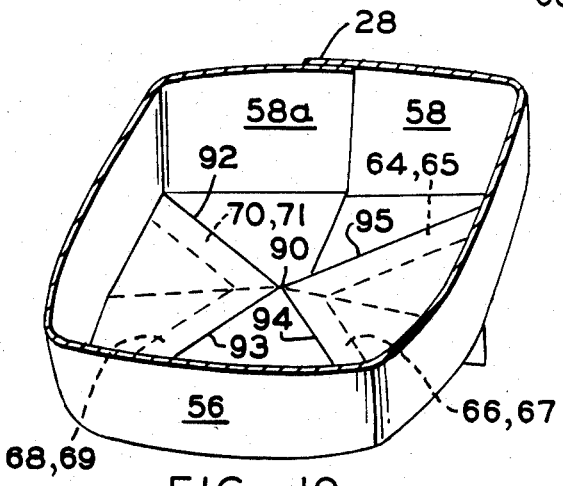
FIG. 10 is a perspective view of the end portion of the bag cut transversely on line 10—10 of FIG. 9.

Refer now to FIGS. 9 and 10 which illustrate the bag in accordance with the present invention in a fully expanded condition, as it appears just before the product is to be removed from the bag. When the bag is fully expanded in this way, the gusset panels will fold along diagonal fold lines extending from the center 90 of the bag diagonally outward toward the corners as shown by the folds designated 92–95 (FIG. 10). This will form a flat bottom for the bag indicated generally at B. This eliminates portions of the gussets which might otherwise be trapped between the bottom seals and get in the way of the product or interfere with easy removal of the product from the bag. The result is that a single large uninterrupted compartment is formed as clearly shown in the FIG. 10 which illustrates bottom portion of the bag as it would appear if it were cut off and removed.

Figure 5:
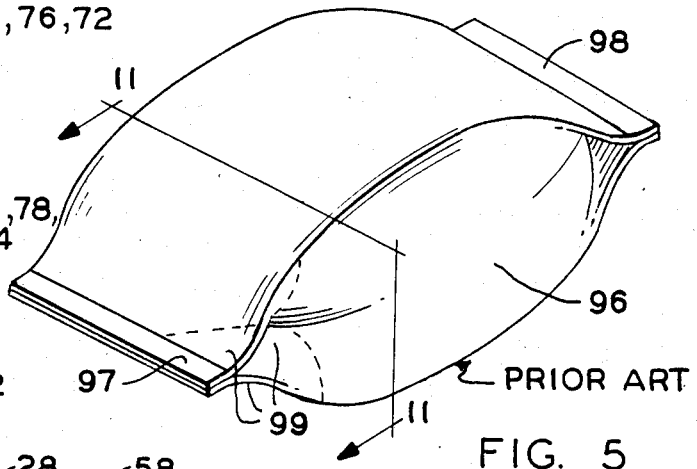
FIG. 5 is a perspective view having a conventional square end gusseted bag in accordance with the prior art as it appears after being expanded.
Figure 11:
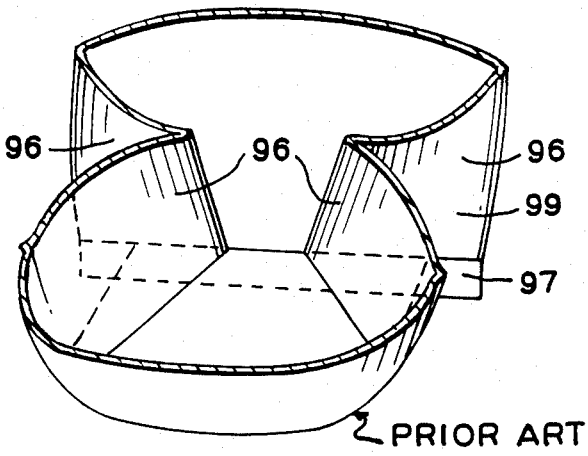
FIG. 11 is a perspective view of the end portion of a bag in accordance with the prior art.
Figure 12:
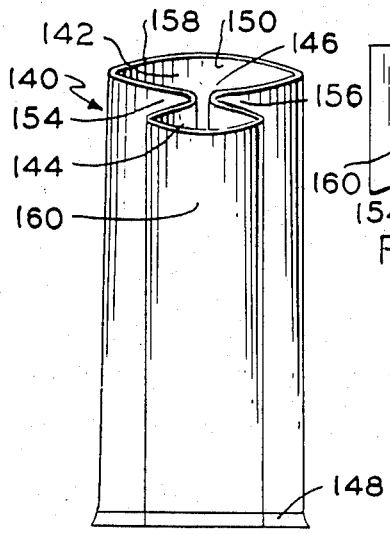
FIG. 12 is a perspective view of a bag in accordance with the invention.

By contrast, a conventional gusseted square bottom bag according to the prior art is shown in FIGS. 5 and 11. The gussets in the prior art bag are designated 96, only one of which is shown in FIG. 5. From the drawing, it can be seen that both the bottom and top portions of the gussets 96 are captivated, entrapped within the folds of the bottom and top seals 97 and 98 respectively. As a result, portions of the gussets 96 (FIG. 11) of paper can get in the way of the product and in some cases cause parts of the product to become trapped or jammed in place, for example in the corners 99 (FIG. 5).

By contrase, inspection of FIG. 10 will show that because the diagonal seals 64–71 cause the gussets to fold as described, the interior of the bag is unobstructed promoting quick and easy removal of the product and preventing it from becoming stuck in place as well as allowing an expansible product to expand freely.

The term "diagonal seal" means a seal that is diagonal on one edge. The triangular area below seals 64–71 can be entirely covered with adhesive. Moreover, adhesive can cover the entire surface of the paper. In this case the position of the jaws alone can be used to determine where seals are located. Thus, the heat seal can be determined by the pattern of the heat seal adhesive or by the pattern of the jaws. The amount of heat used and the inherent strength of the adhesive can be used to control the quality of the adhesive joints.

Because of the action of the diagonal seals described, the fold lines 51, 54 can be brought closer together in the present invention than in the prior art. This is an advantage since the closer the fold lines 51, 54 are to each other, the more completely the bag will be divided into two separate tubes and as a result, the better the product 84 can be reliably retained in its assigned location within the front tube adjacent the front face 56 with none leaking or falling into the tube adjacent the back panel.

By inspection of FIG. 9, it will be seen that the very top part of the gussets (adjacent the top seal of the bag) are free to spread apart when the bag is expanded. Because of this, the top of the bag where it is sealed straight across is slightly weaker than the bottom where it is sealed all the way across at 42. Accordingly, if the bag is used to hold an expansible product, the bottom seal 42 will remain intact although the top pops open from internal pressure. This makes the bag perform in a more predictable way. For example, in the popping of popcorn, it is important for the bag bottom to remain sealed. The product is removed by manually opening the top of the bag. Consequently, the start of an opening at the top of the bag produced by internal pressure is acceptable. In this application, the seal 40, in effect, peels open when internal pressure becomes excessive. By having the top seal of the bag weaker than the bottom seal, the bag will always pop open at the top and can be thought of as "self venting" and will always open at the same spot with a peeling action beginning at the point located between the gusset fold lines 51, 54 where they are captured in the top seal 40. The importance of this in some applications is that the bag will not burst open tearing along a considerable part of its length when internal pressure develops but instead will always open reliably at the same point; the center of the top seal 40.

Diagonal seals similar to those used on the bottom can also be used on the top if desired although they have not been shown in the drawings for simplicity of illustration.

By having the gussets close together, a larger volume is provided to contain an expansible product. For example, in the case of popcorn the bag must be big enough to hold all of the popped product, in that case the small tube may have a width of about 4" while the large tube has a width of about 5½" for a bag 11" long, the gussets extending to the center or almost to the center of the bag provide virtually complete separation between the front and rear tubular portions of the bag and are sufficiently close together to prevent product in the front tube from transferring readily to the back tube.

The invention has other advantages. Because the bag is suited for manufacture on high speed automatic forming and filling equipment, the cost of the bag is reduced and quality control is improved. Moreover, product placement can be accurately and reliably controlled by allowing the product to fall against the lower product locating seal 74, 78, 82 rather than falling all the way to the bottom end of the bag which is undesirable. Moreover, the bag in the flattened condition of FIGS. 3*a*, 4, 4*a* and 6 can be easily and reliably fed from one station to another by means of rollers or the like (not shown) engaging the outer edges of the bag while the bag is filled with product 84. The upper product locating seal 72, 76, 80 is not needed for some applications but will hold the product in place even though the bag is shaken or turned upside down. If the product is large or need not be accurately positioned, both temporary product locating seals can be eliminated. The top product locating seal also helps to prevent the product 84 from deforming in case it is partially liquid or plastic and the bag is laid on its side with the product capable of flowing from the designated position upwardly in the bag.

The diagonal bottom seals while important for some applications are not needed for other applications and in that case can be eliminated. It will also be understood that the bottom and top of the bag are interchangeable and that the terms "bottom" and "top" are relative to one another.

The sheet material 14 from which the bag is formed can be any suitable flexible packaging material such as paper, plastic or special paper such as greaseproof paper or cellophane. Laminates can also be used such as a laminate composed of 25 lb. grease-proof paper laminated to a 30 lb. kraft paper.

While the seals at the bottom of the bag have been shown as diagonal seals, it should be understood that the entire area below each adjacent diagonal seal can be sealed to the adjacent panel, i.e., the entire area under sealing bands 64, 65 can be coated with adhesive and sealed to the adjacent panel.

Figure 15:
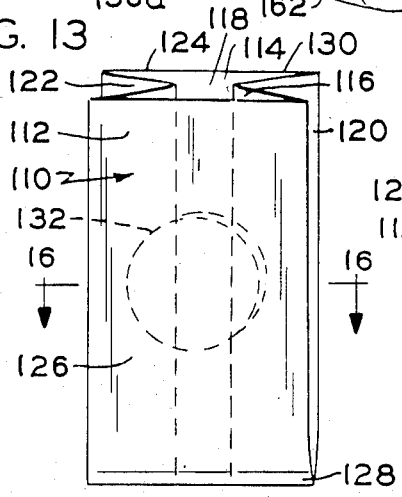
FIG. 15 is a perspective view of another form of bag containing a product.
Figure 16:
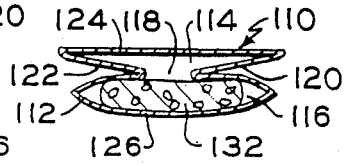
FIG. 16 is a cross-sectional view taken on line 16—16 of FIG. 15.
Figure 18:
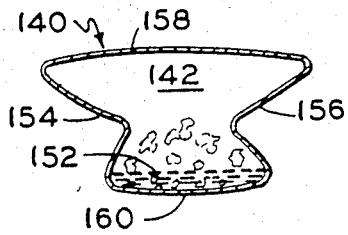
FIG. 18 is a view similar to FIG. 17 as it appears when the product expands in the bag.

Refer now to FIGS. 15 and 16. These figures illustrate a form of the invention in which the bag has face panels of equal size. In this case, the bag 110 is formed from flexible sheet material such as paper having front and rear face panels 126 and 124 respectively connected together by gussets 120 and 122. The gussets 120, 122 separate the bag into a pair of parallel longitudinally extending tubes 114 and 116. The tubes 114 and 116 communicate with one another along a central longitudinally extending opening 118 between the central fold lines of the gussets 120, 122. The bottom of the bag is sealed as shown at 128. After being filled, the top 130 is also sealed conventionally by means of heat or other suitable adhesive.

As shown in FIG. 15 and 16, a product 132 is placed in the forwardmost tube 116 while the tube 114 is maintained substantially free of any product. The placement of the product 132 within tube 116 is clearly shown in FIG. 16.

Figure 13:
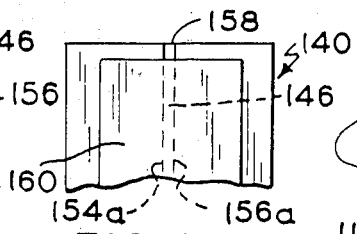
FIG. 13 is a partial side elevational view of the top of the collapsed bag of FIG. 1.
Figure 14:
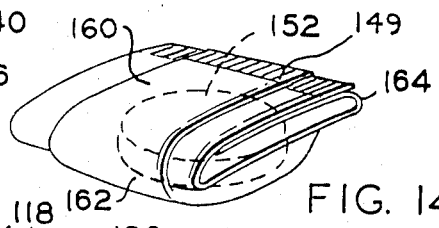
FIG. 14 is a perspective view of a filled bag folded for shipment.
Figure 19:
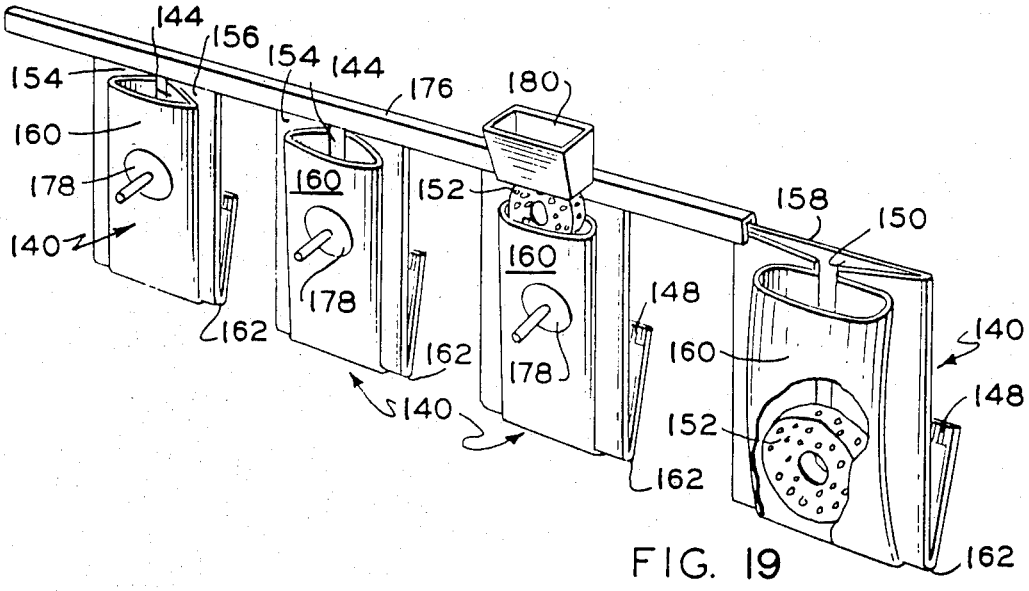
FIG. 19 is a diagramatic perspective view of one method of filling the bags in accordance with the invention.

Refer now to FIGS. 12, 13, 14 and 17–19 which illustrate another form of the invention. In this case, the bag 140, like the embodiments shown in FIGS. 1–11, is composed of parallel tubes of different widths. In this case, a pair of collateral tubes designated 142 and 144 extend longitudinally and communicate with each other along a mid-line at 146. The front tube 144 is about ⅔ the width of the rear tube 142. The tubes communicate with each other along the mid-line at 146 between the center folds of the gussets 154, 156. The bag is sealed by means of a bottom seal 148 and prior to being filled is open at the top so that a product can be introduced as shown in FIG. 19. After the product 152 has been inserted, the top is sealed as shown at 149 in FIG. 14. After being manufactured, the bag is usually flattened as shown in FIG. 13 with the central fold lines of the gussets 154*a*, 156*a* very close together, preferably close enough to prevent product that is in the front tube 144 from transferring accidentally into the back tube 142. It will be seen that the face panel 158 at the rear is larger than the face panel 160 which comprises the front of the bag. It is preferred that the panel 160 be about 18–50% smaller than the area of panel 158. It can therefore be understood that the tube 144 is smaller in cross-section than tube 142. The term "cross-section" herein has reference to a tube that is fully expanded to a circular cross-sectional configuration. The bag 140 is preferably formed from a sheet of paper of one or two plys in thickness formed into a tube as described above and cut apart at longitudinally spaced intervals to define the top and bottom ends 150 and 148 respectively. As shown in FIGS. 14 and 19, the product is placed substantially intermediate the ends of the bag. After being filled and sealed, the bag is folded transversely at 162 and 164 (FIG. 14) to divide the bag roughly into three equal sections for convenient shipment with the product approximately in the center of the bag as best seen in FIG. 14.

Figure 17:
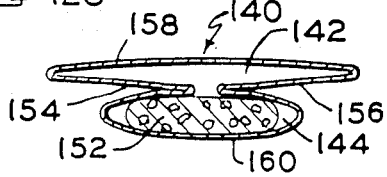
FIG. 17 is a cross-sectional view similar to FIG. 16 of the kind of bag shown in FIG. 12.

The product 152 is placed in the tube 160 having the smaller cross-section and as can be clearly seen in FIGS. 17 and 19, the product 152 is on one side, that is to say, laterally of the mid-line of the bag 140. This maintains the larger tube 142 substantially free from any product.

Refer now to FIG. 19 wherein the same numerals refer to corresponding parts illustrated in FIGS. 12–14, 17 and 18. The bags 160 in this case have been folded transversely along the fold line 162 located at a point about ⅔ of the way between the top and bottom of the bag. This corresponds to the location of the lower product locating seal described in the earlier embodiments of the invention. The bags are located in an upright position during filling and are transferred laterally from left to right in the figure using any well-known filling machine that is commercially available. During the filling operation, the bags 140 are carried from left to right by means of a conveyor that is a part of the transfer and filling machine (not shown). In this form of the invention, the upper end of the tube 144 is shorter than the tube 142. This is accomplished by cutting off the top portion of tube 144 beginning at the marginal edges 154*a* and 156*a* of the gussets 154 and 156. The upper edge of the tube 142 slides within a downwardly opening U-shaped guide rail 176. This allows the tube 144 to be opened at the proper time by means of a suction cup 178 which engages panel 160 and draws the panel away from the panel 158. A filling spout 180 is placed in proximity with each successive bag such that its bottom end is aligned with the upper open end of the small tube 144. As the bag passes beneath the filling spout 180, a product is inserted and as can be seen, falls entirely within the tube 144 so that the larger collateral tube 142 is maintained substantially free of any product. The transverse fold 162 in this case maintains the charge 152 in approximately the center of the bag, that is to say, intermediate the ends 148 and 150. The function of a fold 162 in holding the product can be accomplished in other ways, for example with a clamp placed on the bag. After filling, the top 150 of the bag is sealed in any conventional well-known manner as by means of adhesive or heat sealing.

Figure 20:
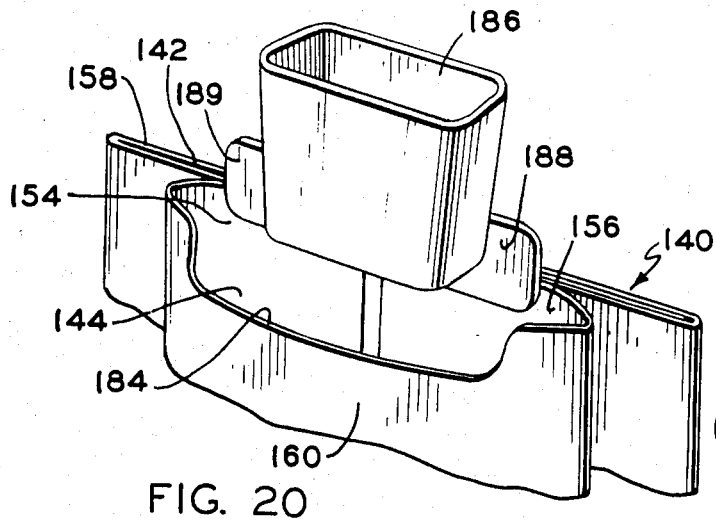
FIG. 20 is a partial perspective view of the top of a modified form of bag in accordance with the invention showing another means of filling the bag.
Figure 21:
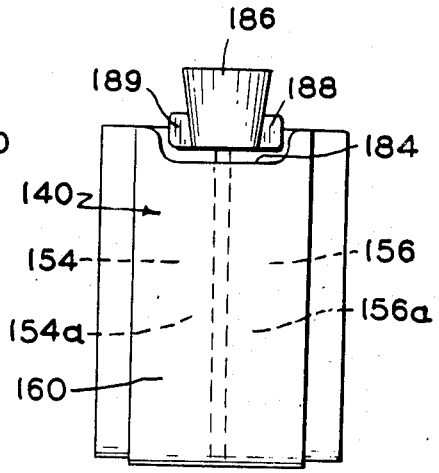
FIG. 21 is a vertical side elevational view of the filling operation illustrated in FIG. 20.

Refer now to FIGS. 20 and 21 in which the same numbers refer to corresponding parts shown in previous views. The bag 140 is the same as previously described except instead of the entire upper end of the tube 144 being shorter than tube 142, a cut-out section 184 is provided entirely within the panel 160. The cut-out 184 may extend downwardly toward the bottom of the bag about ½" to 1" to accommodate a filling spout 186 having tabs or lateral extensions 188 and 189 which engage the uppermost edge of the gussets 156 and 154 respectively. The spout and its extensions 188 and 189 hold the gussets on top of the bag against the upper edge of the large tube 144 which is, in turn, pressed against a vertical plate or other surface which for simplicity has not been shown in the figures. After the spout 186 and the extensions engage the gussets 154 and 156, the panel 160 is pulled outwardly, for example by a suction cup (not shown) to open the tube 144. Once tube 144 is opened, the product is dropped in the spout 186 and allowed to fall into the tube 144 thereby locating it in the desired position entirely within tube 144. The tube which will be maintained in a flattened condition at this point will be substantially free of any product.

Figure 22:
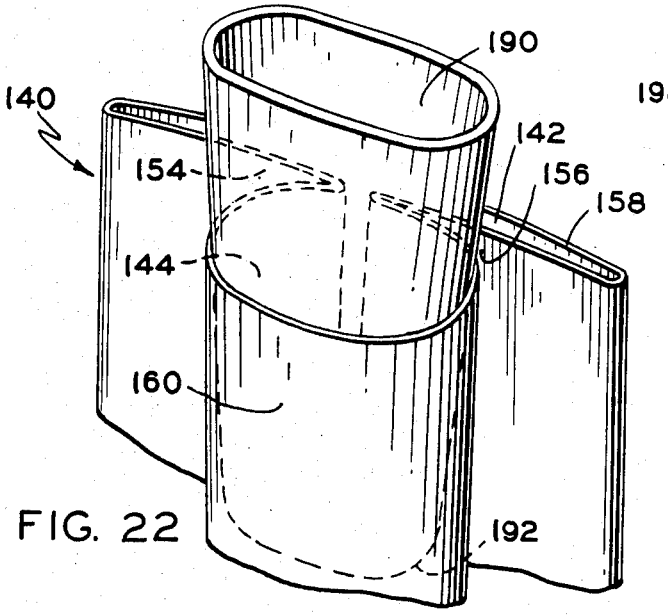
FIG. 22 is a perspective view of another method of filling the bags in accordance with the invention.

FIG. 22 illustrates a similar filling method wherein the same numerals refer to corresponding parts. In this case, a filling spout 190 is used. The spout 190 is not provided with tabs and is somewhat longer from top to bottom than spout 186. In this filling method, the lower open end 192 of the spout 190 is inserted into tube 144 which is then drawn upwardly over the spout. As can be seen, this will open the tube 144 allowing the product to be introduced while the collateral tube 142 remains flattened and free from any substantial quantity of product. It is to be understood that in all of the embodiments of the invention, incidental quantities of product may spill over into the unfilled tube. Such spillover which sometimes happens in high speed commercial production lines will not depart from the spirit or scope of the present invention.

Figure 23:
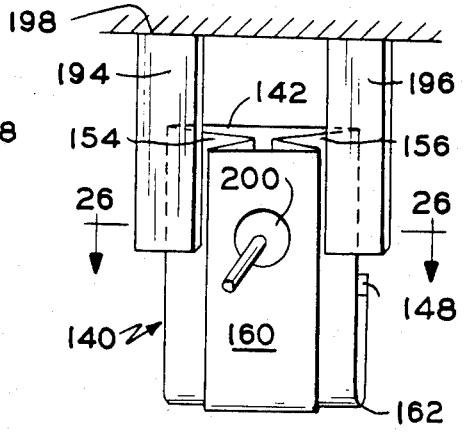
FIG. 23 is a perspective view of another filling method.
Figure 24:
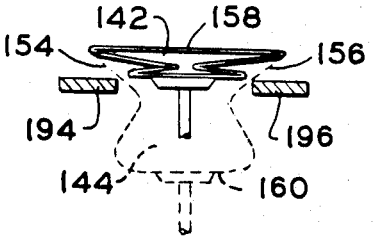
FIG. 24 is a horizontal cross-sectional view taken on line 24—24 of FIG. 23.

FIGS. 23 and 24 show a similar filling method except that no spout is employed. In this case, a pair of parallel downwardly depending fixed retaining arms 194 and 196 are supported from a stationary framework 198 to hold the side edges of the flattened tube 142. A suction cup 100 engages panel 160 and draws it away from panel 158 thereby opening the smaller collateral tube 144. The product is then inserted into tube 144.

Figure 25:
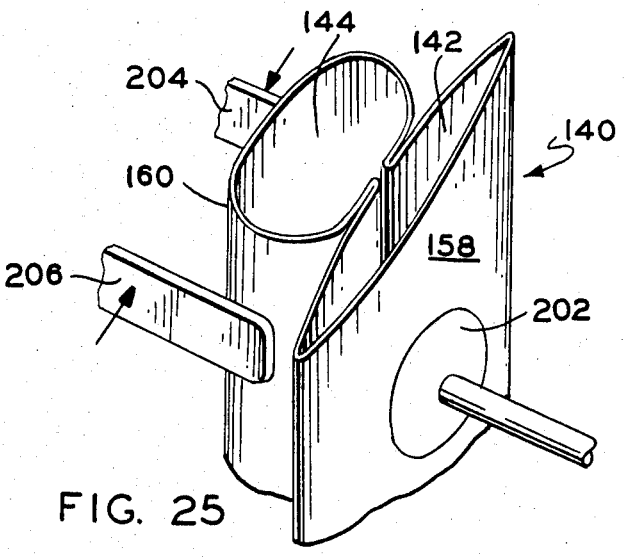
FIG. 25 is a perspective view illustrating still another method of filling bags in accordance with the invention.

FIG. 25 shows a somewhat similar arrangement except that in this case panel 158 is engaged by a stationary suction cup 202 and a pair of picture arms 204 and 206 engage the side edges of the panel 160. They are then brought centrally toward one another in the direction shown by the arrows thereby pinching the tube 144 to expand it for filling. Once tube 144 has been expanded as shown in the figure, the product is introduced.

Many variations of the invention within the scope of the appended claims will be apparent to those skilled in the art.

What is claimed is:

1. A square end gusseted bag construction comprising a pair of opposing front and back rectangular face panels of the same length having parallel top and bottom edges and parallel side edges at right angles thereto, left and right connecting gussets extending between the front and back panels of the bag, each having a pair of left and right gusset panels respectively adjacent each other and connected together by a gusset fold, the gussets extending toward the center of the bag when the bag is in a flat condition and the gusset folds being close enough together when the bag is flat to separate the bag into a pair of connected tubes, top and bottom seals extending across the bag from one side edge thereof to the other adjacent to the top and bottom edges of the bag, permanent diagonal seals at the bottom of the bag to form a strong permanent seal, the permanent diagonal seals comprising seals between the gussets and the face panels including a first pair of diagonal seals on the left side of the bag beginning at the center of the bag and being inclined laterally between each gusset panel and a portion of an adjacent face panel in contact therewith, a second pair of diagonal seals beginning at the center of the bag and being inclined toward the right between each of the right gusset panels and an adjacent face panel, a temporary seal dividing the bag into a plurality of interconnected communicating compartments comprising at least one transversely extending product locating seal defined by a transversely extending band of heating sealing adhesive to temporarily seal one face panel to adjacent gussets to initially hold the gussets in a tucked-in condition adapted to hold a product in place on one side of said bag between said gussets, said temporary seal being provided in the bag between at least one face panel and an adjacent portion of a gusset panel to seal at least one of the tubes transversely at a point located intermediate to the ends of the bag to separate at least one of the tubes into at least two separate connected compartments that communicate with one another between the gusset folds including a first compartment adapted to enclose said product and a second compartment, said one face panel and said temporary seal being adapted to weaken when the bag and a product contained therein is heated to permit the gussets to pop out and thereby allow expansion of the bag and said product, said expansion enabling the product to shift from said one side of the bag to fill the entire bag, and said permanent diagonal seals remaining intact after expansion of the bag to provide a sealed bag bottom free from confining corner folds within which if present portions of the product could otherwise become trapped.

2. The bag construction of claim 1 wherein a pair of laterally extending longitudinally spaced apart transverse temporary seals are provided sealing the face panels to the adjacent gusset panels to provide six spaced apart compartments including first and second top communicating compartments in the connected tubular sections of the bag between the temporary seal in the top of the bag, a pair of centrally located communicating compartments within the connected tubes between the two transverse temporary seals and a third pair of communicating compartments between the lower temporary seal in the bottom of the bag in the two connected tubes.

3. The product of claim 2 wherein a packaged product is located in a tube defined by the space between the face panel and the gussets and between two product locating seals.

4. The bag of claim 1 wherein a packaged product is present in the bag within a single tube located between one face panel and the gussets and above said temporary seal.

5. The bag of claim 1 wherein the diagonal seals comprise bands of heat sealing adhesive applied to both mating surfaces of the bag to define two contacting layers of adhesive that are fused together to form the seal and the temporary seal is composed of a single band of adhesive applied to one surface of the bag but not to a corresponding mating surface.

6. A self-venting gusseted bag of differential and strength comprising a pair of opposing front and back rectangular face panels of the same length having parallel top and bottom edges and parallel side edges at right angles thereto, left and right connecting gussets extending between the front and back panels of the bag, each having a pair of left and right gusset panels respectively adjacent each other and connected together by a gusset fold, the gussets extending toward the center of the bag when the bag is in a flat condition and the gusset folds being close enough together when the bag is flat to separate the bag into a pair of connected communicating tubes, a relatively weak top seal and a relatively strong bottom seal extending across the bag from one side edge thereof to the other adjacent to the top and bottom edges of the bag, diagonal seals on at least the bottom of the bag to form a strong seal in the bag when the bag is expanded, the diagonal seals comprising seals between the gussets and the face panels including a first pair of diagonal seals on the left side of the bag beginning at the center of the bag and being inclined laterally between each gusset panel and a portion of an adjacent face panel in contact therewith, a second pair of diagonal seals beginning at the center of the bag and being inclined toward the right between each of the right gusset panels and the adjacent face panel, said diagonal seals providing a stronger seal at the bottom of the bag than the top for venting internal pressure from the top of the bag, said bag thereby having differential end seal strength whereby internal pressure will pop open the top seal to form a vent while the bottom seal remains intact owing to the greater strength of the bottom seal allowing the bag to perform in a predictable way wherein the top seal will open when a predetermined pressure is achieved inside the bag, and the bag will become self-venting as internal pressure causes the top of the bag to open enabling each such bag to open reliably and predictably at the same point, said diagonal seals also forming folds in the gussets when the bag is expanded to produce a flat bottom for the bag free from confining corner folds within which, if present, portions of the product could otherwise become trapped.

7. The product of claim 6 including a temporary seal comprising at least one transversely extending product locating seal defined by a transversely extending band of heat sealing adhesive to temporarily seal one face panel to adjacent gussets to normally hold the gussets in a tucked-in condition and holding said product in place on one side of said bag between said gussets and said one face panel and said temporary seal being adapted to melt when the bag and a product contained therein is heated to permit the gussets to pop out and thereby allow expansion of the bag and enabling the product to shift from one side of the bag to fill the entire bag, said temporary seal being provided in the bag between one face panel and an adjacent portion of a gusset panel to seal at least one of the tubes transversely at a point located intermediate to the ends of the bag to separate at least one of the tubes into at least two separate compartments including an upper compartment adapted to enclose said product and a lower compartment.

8. The gusseted bag of claim 6 wherein the outer exposed surfaces of the gussets at the bottom of the bag are sealed to one another to prevent the gussets from separating at the bottom of the bag and corresponding gusset portions of the top of the bag are not sealed together so that the top part of the gussets are free to spread apart from one another when the bag is expanded thereby helping to make the top of the bag weaker than the bottom so that the bottom seal will remain intact when the top pops open from internal pressure.

9. A square end gusseted bag construction comprising rectangular face panels including opposing front and back panels of the same length having parallel top and bottom edges and parallel side edges at right angles thereto, left and right connecting gussets extending between the front and back panels of the bag, said left and right gussets each having a pair of wide and narrow gusset panels adjacent each other and connected together by a gusset fold, the gussets extending toward the center of the bag when the bag is in a flat condition and the gusset folds being close enough together when the bag is flat to separate the bag into a pair of tubes of different sizes, top and bottom seals extending straight across the bag from one side edge thereof to the other adjacent to the top and bottom edges of the bag, diagonal seals on at least the bottom of the bag to form a flat bottom on the bag when the bag is expanded, the diagonal seals comprising seals between the gussets and the face panels including a first pair of diagonal seals on the left side of the bag beginning at the center of the bag and being inclined laterally between each gusset panel and a portion of an adjacent face panel in contact therewith, a second pair of diagonal seals beginning at the center of the bag and being inclined toward the right between each of the right gusset panels and an adjacent face panel, said diagonal seals forming folds in the gussets when the bag is expanded to produce a flat bottom for the bag, and the diagonal seals defining triangular areas including a first pair of triangular areas of a first width corresponding to twice the width of a wide gusset panel and a second pair of triangles narrower in width than said wide gusset panel corresponding to twice the width of a narrow gusset panel.

10. The bag of claim 9 wherein a transverse product locating seal is defined by a band of heat sealing adhesive applied to an inner back surface and a seal in said band is formed by the application of heat and pressure to bond the front face panel to adjacent sections of the gusset panels.

* * * * *

UNITED STATES PATENT AND TRADEMARK OFFICE

CERTIFICATE OF CORRECTION

PATENT NO. : 4,691,374

DATED : September 1, 1987

INVENTOR(S) : James D. Watkins et al

It is certified that error appears in the above-identified patent and that said Letters Patent is hereby corrected as shown below:

Claim 1, column 11, line 46, delete "said one face panel and".

Signed and Sealed this

Thirteenth Day of September, 1988

*Attest:*

*Attesting Officer*

DONALD J. QUIGG

*Commissioner of Patents and Trademarks*